US005566967A

United States Patent [19]

Wladar et al.

[11] Patent Number: 5,566,967

[45] Date of Patent: Oct. 22, 1996

[54] FRONT JAW FOR A SAFETY SKI BINDING

[75] Inventors: Helmut Wladar; Karl Stritzl, both of Vienna; Andreas Janisch, Oeynhausen; Hubert Wuerthner, Hainburg/Donau, all of Austria

[73] Assignee: HTM Sport-und Freizeitgeraete Aktiengesellschaft, Schwechat, Austria

[21] Appl. No.: 325,190

[22] PCT Filed: Dec. 17, 1993

[86] PCT No.: PCT/EP93/03592

§ 371 Date: Oct. 14, 1994

§ 102(e) Date: Oct. 14, 1994

[87] PCT Pub. No.: WO94/17873

PCT Pub. Date: Aug. 18, 1994

[30] Foreign Application Priority Data

Feb. 15, 1993 [AT] Austria ..... 274/93

[51] Int. Cl.[6] ..... A63C 9/085

[52] U.S. Cl. ..... 280/625; 280/630; 280/634

[58] Field of Search ..... 280/625, 626, 280/628, 630, 631, 634

[56] References Cited

U.S. PATENT DOCUMENTS

| | | | |
|---|---|---|---|
| 4,478,426 | 10/1984 | Scheck | 280/625 |
| 4,735,434 | 4/1988 | Sedlmair | 280/634 X |
| 4,834,414 | 5/1989 | Sedlmair | 280/625 |
| 4,974,869 | 12/1990 | Muhlberger et al. | 280/625 |
| 5,333,891 | 8/1994 | Stritzl et al. | 280/625 |

FOREIGN PATENT DOCUMENTS

| | | | |
|---|---|---|---|
| 0340623 | 11/1989 | European Pat. Off. | 280/628 |
| 0303026 | 10/1992 | European Pat. Off. . | |

*Primary Examiner*—Brian L. Johnson

*Attorney, Agent, or Firm*—Flynn, Thiel, Boutell & Tanis, P.C.

[57] ABSTRACT

A front jaw for a safety binding comprising a housing (2,3), which can be fastened on a ski, the housing having a lower part (3) and an upper part (2), and at least one adjustable release spring (4), with two essentially horizontally swingable sole holders (**14*a*, 14*b*) being arranged in the upper part (2) of the housing, which sole holders are supported on a common, essentially vertically oriented bolt (13), which bolt is loaded by the release spring (4) and is movably guidably arranged in the housing (2, 3) along a rearwardly enlarging guide surface (130**) aligned in a longitudinal direction.

3 Claims, 3 Drawing Sheets

FRONT JAW FOR A SAFETY SKI BINDING

FIELD OF THE INVENTION

The invention relates to a front jaw for a safety binding comprising a housing adapted to be fastened onto a ski, the housing having a lower part and an upper part, at least one adjustable release spring and two essentially horizontally swingable sole holders arranged in the upper part of the housing, which sole holders are supported on a common, essentially vertically oriented bolt which is loaded by the release spring and is guided in the housing.

BACKGROUND OF THE INVENTION

A front jaw of the abovementioned type has become know, for example, from AT 376 576 and its corresponding U.S. Pat. No. 4,478,426. The sole holders in this known front jaw are supported on a common bolt which is loaded by the release spring through a pull rod, the pull rod being movably guided in a bore provided in the housing and extending in a longitudinal direction.

Furthermore, a front jaw with diagonal release capability is already known from an Austrian patent application of the Applicant with the reference AT-PS 396 337 and its corresponding U.S. Pat. No. 5,333,891. The sole holders are pivotally supported on a bearing block in such a front jaw, which bearing block is supported and guided on the housing. The sole holders are loaded through a center opening in this bearing block through a release plate by the spring force of the release spring. The bearing block is furthermore guided at its lower end by a recess and a wedge-shaped projection received therein so that the bearing block, after moving through a predetermined release path, can also swing-out laterally, thus enabling a diagonal release of the front jaw.

SUMMARY OF THE INVENTION

A purpose of the invention is to provide a diagonal release in addition to a lateral and rearward release also possible in a conventional front jaw of the abovementioned type.

One purpose of the invention is in particular to find an arrangement which is as simple and inexpensive as possible, and which enables such a diagonal release.

This is accomplished according to the invention by means of a front jaw of the above-mentioned type in which the bolt is movably guidably arranged along a guide surface aligned in longitudinal direction and enlarging rearwardly, which guide surface is provided in a centrally oriented guide plate arranged in the upper part of the housing, and which is associated with the lower end section of the bolt. The bolt is, during a diagonal release, guided first rearwardly in a longitudinal direction and thereafter swings out laterally, after following a predetermined release path, caused by the application of a diagonal force and the widening of the guide surface, thus enabling a release of the ski shoe in an upwardly inclined direction for a diagonal release. An advantageous combination of the diagonal release with the other release operations (lateral, rearward release) is thereby also achieved, with the sole holders, the bolt and the release spring being already premounted in the upper part of the housing.

The solution of the invention is realized advantageously in such a manner that the guide surface is designed as an elongated slot having a rounded area at its front end and a tapered enlargement at its rear end.

From the design of the disclosed exemplary embodiment, the bolt, in an advantageous manner, and in the skiing position of use of the front jaw, is guidedly supported on a first and/or second guide-surface section and in the swung-out state of at least one sole holder either on the second or on a third guide-surface section of the guide surface, with the first guide-surface section being designed as a straight section of the elongated slot and the third guide-surface section as the boundary walls of a tapered enlargement.

BRIEF DESCRIPTION OF THE DRAWINGS

The invention will be discussed in greater detail hereinafter in connection with the accompanying drawings, in which.

DETAILED DESCRIPTION

Figure 1:
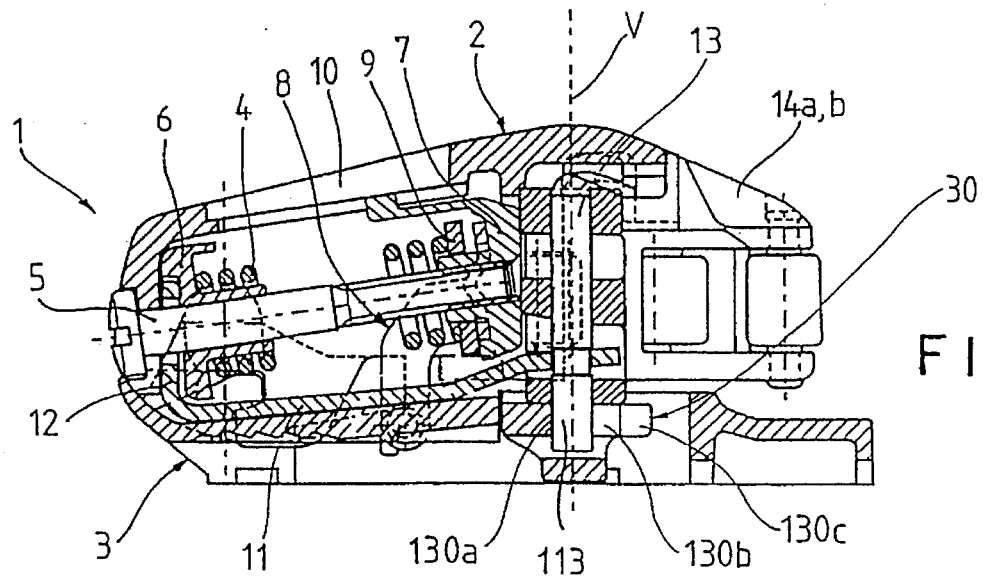
FIG. 1 is a cross-sectional view of a front jaw of the invention in its position of use.
Figure 2:
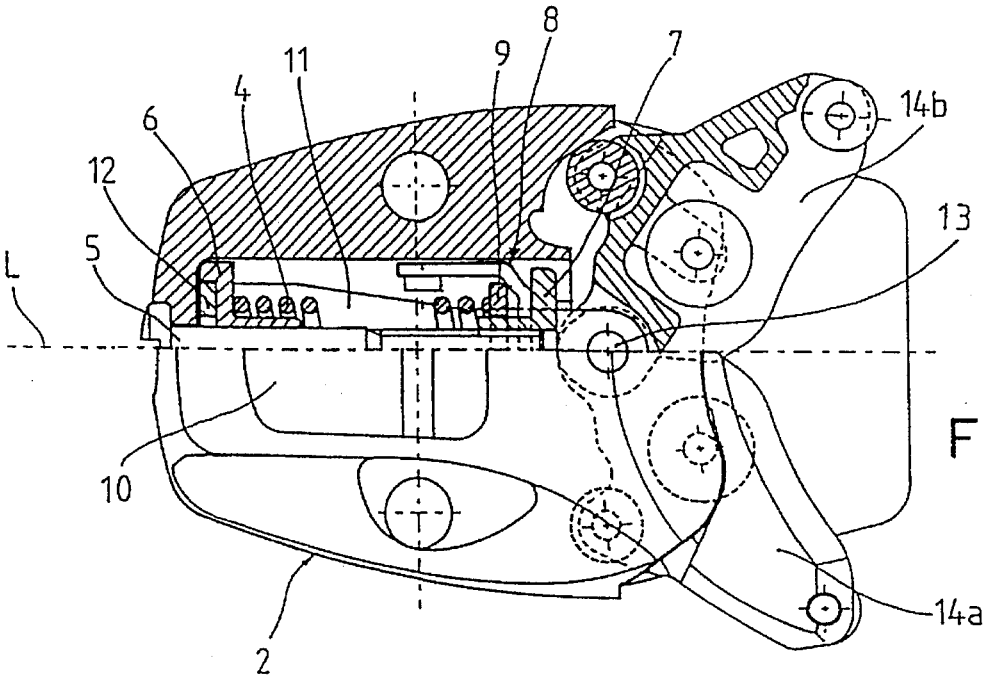
FIG. 2 is a partially cross-sectioned top view of the front jaw according to FIG. 1.

First, reference is made to FIGS. 1 and 2 which illustrate a front jaw 1 of the invention having a lower part 3 and an upper part 2 pivotally supported on the lower part 3 through a schematically indicated pivot. A release spring 4 is supported between a front spring-support plate 6 and a rear spring-support plate 7 in the upper part 2 of the housing, with the front spring-support plate 6 being supported through the release system on the upper part of the housing and the rear spring-support plate 7 being mechanically connected through an adjusting screw 5 to the front side of the upper part 2 of the housing. The upper part of the rear spring-support plate 7 is designed as an indicator and indicates to the user through a window 10 provided on the upper side of the upper part of the housing the initial tension of the release spring 4, which initial tension is adjusted with the aid of the adjusting screw 5. A two-arm spring lever 8 and a bearing plate 9 are additionally inserted between the release spring 4 and the rear spring-support plate 7 in the illustrated embodiment, the angular spring lever 8 being supported on the rear spring-support plate 7 and acting with one lever arm through the bearing plate 9 on the release spring 4 and with its second lever arm on the lower part 3 of the housing. This spring lever 8 thus permits a slight pivoting of the upper part 2 of the housing against the spring force of the release spring 4 in an upward direction and, therefore, an automatic and stepless adjustment of the sole holders 14*a*, 14*b* to the height of the sole of a ski shoe.

Furthermore, an angle part 12 on a pull piece 11 is inserted between the front spring-support plate 6 and the front side of the upper part 2 of the housing, the pull piece, in the illustrated exemplary embodiment, extending rearward from the angle part 12 beneath the release spring 4. An essentially vertically oriented bolt 13 is coupled to the rear end of the elongated pull piece 11, on which bolt the sole holders 14*a*, 14*b* of the front jaw are pivotally supported. The sole holders 14*a*, 14*b* are supported in such a manner on the upper part of the housing that a lateral, rearward and diagonal release of the front jaw is possible. The structural design of the support of the sole holders on the housing is not part of this invention and will, therefore, not be described in detail hereinafter. One exemplary embodiment for such a support is, for example, discussed in a parallel patent application of the Applicant, Austrian Patent Application A 2532/92 and its corresponding U.S. patent application No. 08/290,930, pending. The bolt 13 is guided in the housing during a release operation. The lower end section 113 of the bolt 13 is for this purpose associated with a guide plate 30, which will be described in greater detail hereinafter with reference to FIGS. 3 and 4.

Figure 3:
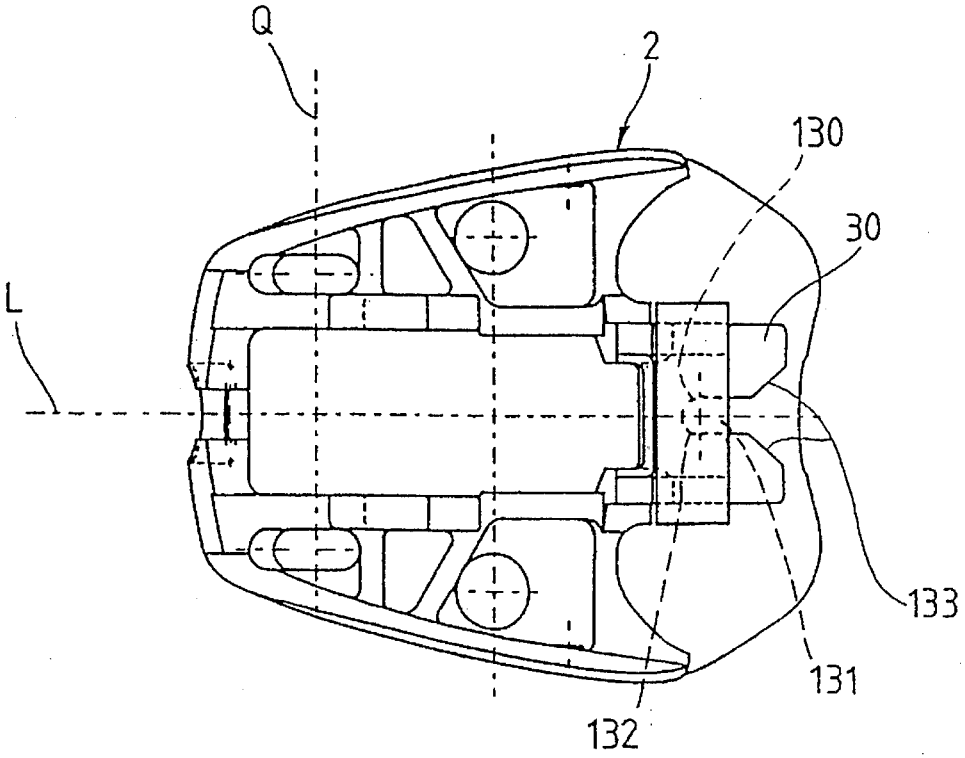
FIG. 3 is a schematic bottom view of the upper part of the housing of a front jaw of the invention.

FIG. 3 shows a bottom view of the upper part 2 of the housing of a front jaw 1 of the invention, which is here shown without the release spring 4, the sole holders 14*a*, 14*b* and other parts. Support elements for the pivotal support of this upper part 2 on the lower part 3 of the housing are provided in the front part of the upper part 2 of the housing. These elements, however, are not discussed in detail. A centrally oriented guide plate 30 is provided in the rear part of the upper part 2 of the housing, along which guide plate is movably guided the bolt 13 provided with the sole holders 14*a*, 14*b*. The guide surface 130 of this guide plate 30 is an elongated slot, the sidewalls of which diverge in a rearward direction and thus enables, in addition to the lateral and rearward release, also a diagonal release of the front jaw, in particular during backward twisting falls.

Figure 4:
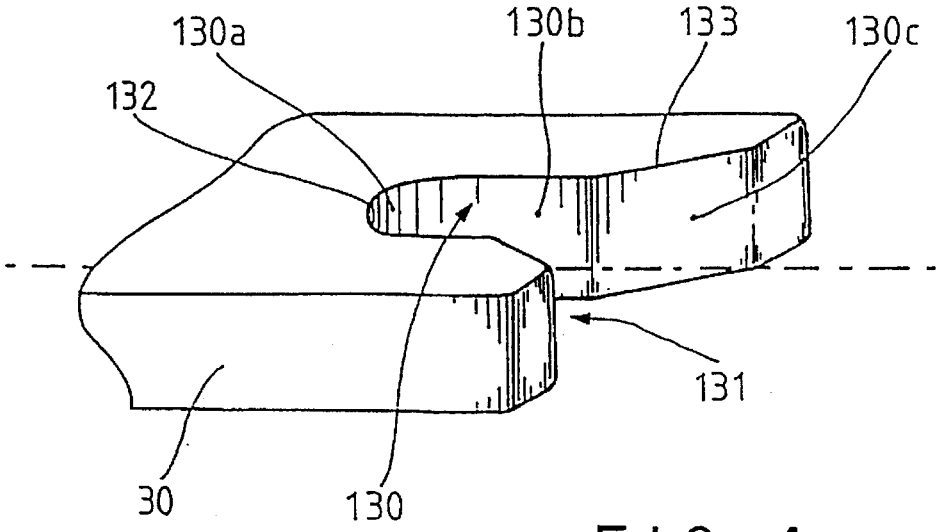
FIG. 4 is an isometric view of the guide plate according to FIG. 3.

FIG. 4 shows the guide plate 30 shown in FIG. 3 in an isometric view. The guide surface 130 consists of three partial sections 130*a*, 130*b*, 130*c* provided on opposite sides of an elongated slot 131. A curved end area 132 is provided at its front end and a tapered enlargement 133 is provided at its rear end.

Figure 5:
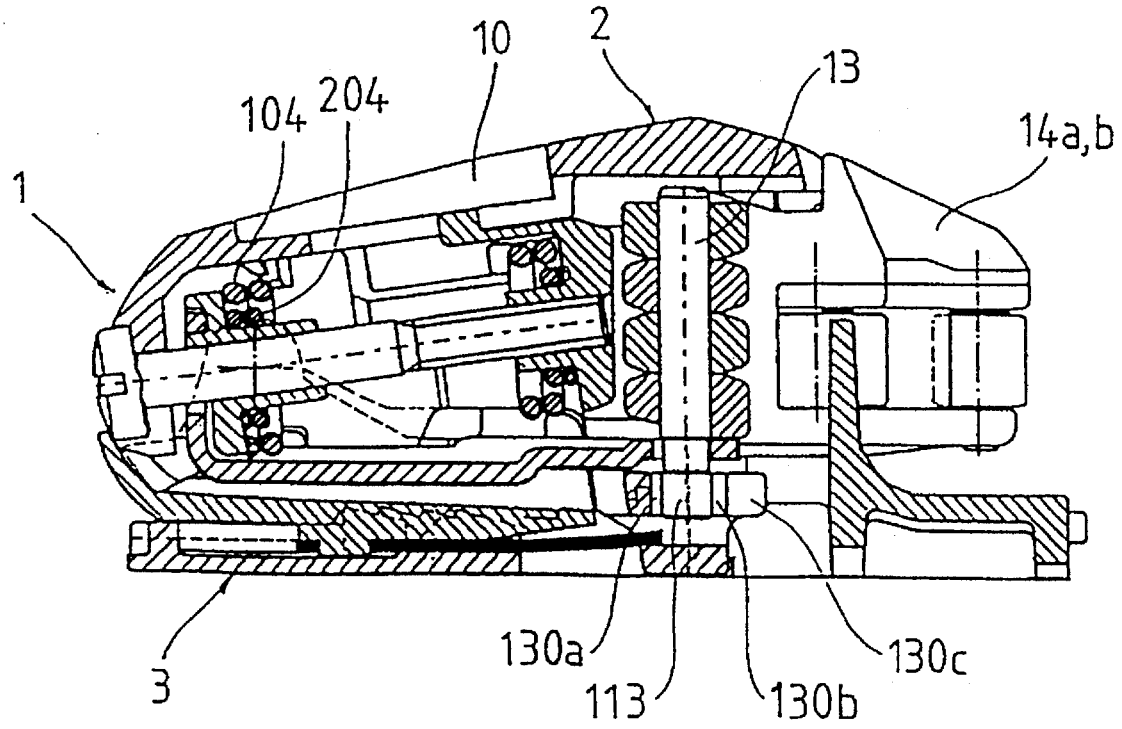
FIG. 5 is a cross-sectional view of a further embodiment of a front jaw of the invention in its position of use.

FIG. 5 shows the invention of a further embodiment of a front jaw in which the release spring is in the form of two concentric springs 104, 204. The bolt 13 in this front jaw is shown to have been already guided slightly rearwardly in the sense of a release along the guide surface 130.

Just like in the exemplary embodiment illustrated in FIG. 1, a spring force acts also in the front jaw illustrated in FIG. 5 between the upper part 2 of the housing and the lower part 3 of the housing, which spring force enables, in connection with a joint and a locking piece, a stepless elevational adjustment of the sole holders 14*a*, 14*b* to the height of the sole of the ski shoe. This spring force is in the present case a leaf spring, not identified in detail, supported in the lower part of the housing and acts on a stop provided on the upper part of the housing.

The support bolt 13 for the sole holders 14*a*, 14*b* is swung out of its vertically oriented position during a rearward release so that its lower end 113 is guided rearwardly along the guide surface 130 provided in the guide block 30, following the first guide-surface section 130*a* and then along the second guide-surface section 130*b*. The force acting upwardly onto the sole holders 14*a*, 14*b* must be sufficiently large to effect a rearward release and in order to swing out the sole holders sufficiently far so that the ski shoe can slide upwardly out of the front jaw. The tapered enlargement 133 or rather the third guide-surface section 130*c* of the guide surface 130 for the support bolt 13 permits, particularly in the case of backward twisting falls, a swinging of the support bolt 13 out of its central position and a diagonal release of the front jaw enabling the ski shoe to be released in an upwardly inclined direction.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a front jaw for a safety binding comprising a housing adapted to be fastened on a ski, the housing having a lower part and an upper part connected to each other at a front end of the housing, at least one adjustable release spring within the housing, two generally horizontally swingable sole holders arranged in the upper part of the housing and movable between first and second positions, and a common, generally vertically oriented bolt mounted in the housing, the sole holders being supported on the bolt and biased by the release spring towards the first position, the improvement comprising a centrally oriented guide plate mounted on the upper part of the housing, a pair of opposing rearwardly diverging guide surfaces each aligned in a longitudinal axis of the guide plate, wherein the bolt is supported for movement relative to the guide surfaces, and wherein a lower end section of the bolt is received between the guide surfaces and is guided thereby.

2. The front jaw according to claim 1, wherein the guide surfaces define an elongated slot having a curved area adjoining the guide surfaces at a front end of the elongated slot and a diverging enlargement at a rear end of the elongated slot.

3. The front jaw according to claim 2, wherein each of the guide surfaces at a rear end of the elongated slot has a first section and a second section, wherein the bolt when the front jaw is in a skiing position and the sole holders are in the first position, is guidedly supported between the first sections and abuts the curved area and, in a swung-out releasing position at the second position of at least one of the sole holders, between the second sections, and wherein each of the first sections are straight and extend parallel to the longitudinal axis to define the elongated slot and the second sections are angular to the respective first sections to define the diverging enlargement.

* * * * *